US006142697A

United States Patent [19]

Williams

[11] Patent Number: 6,142,697

[45] Date of Patent: Nov. 7, 2000

[54] RING LOCK FOR ALBUM OR BINDER

[75] Inventor: Randall Dale Williams, Cornish, N.H.

[73] Assignee: Intercraft Company, Statesville, N.C.

[21] Appl. No.: 09/388,977

[22] Filed: Sep. 2, 1999

[51] Int. Cl.[7] ..... B42F 13/20

[52] U.S. Cl. ..... 402/31; 402/26; 402/39; 402/41

[58] Field of Search ..... 402/26, 31, 36, 402/37, 38, 39, 40, 41, 42, 43, 44, 45, 46, 52, 54, 55, 56

[56] References Cited

U.S. PATENT DOCUMENTS

| | | | |
|---|---|---|---|
| 3,910,708 | 10/1975 | Rohner . | |
| 4,434,534 | 3/1984 | Handler . | |
| 5,692,848 | 12/1997 | Wada | 402/31 |
| 5,868,513 | 2/1999 | Law | 402/31 |
| 5,906,449 | 5/1999 | Ostrander | 402/46 |
| 5,975,784 | 11/1999 | Whaley | 402/31 |
| 6,036,394 | 3/2000 | Cheng | 402/31 |

*Primary Examiner*—A. L. Wellington
*Assistant Examiner*—Monica Carter
*Attorney, Agent, or Firm*—Foley & Lardner

[57] ABSTRACT

A lock for the rings of photo albums and other binders includes a lock and a security component to prevent opening of the album in a retail store and to prevent pilferage of the contents or the improper insertion of refill pages. Once a consumer has made an album selection, the security component is removed. Once removed, the lock is moveable between a first position in which opening of the album rings is permitted and a second position in which opening of the rings is prevented. The initial release of the security component preferably requires a tool. In the most preferred embodiment, the lock slides in a slot in a binder body and includes a lower ridge which aligns with an opening in a pair of spring plates to permit ring opening. When the ridge is moved away from the opening and into the cavity of the binder body, the rings cannot be opened.

25 Claims, 3 Drawing Sheets

FIG. 3
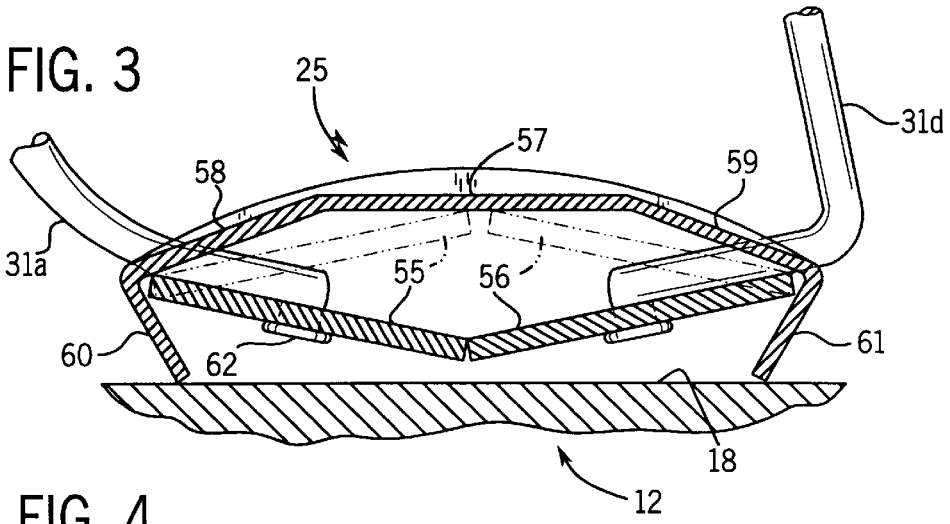
FIG. 4
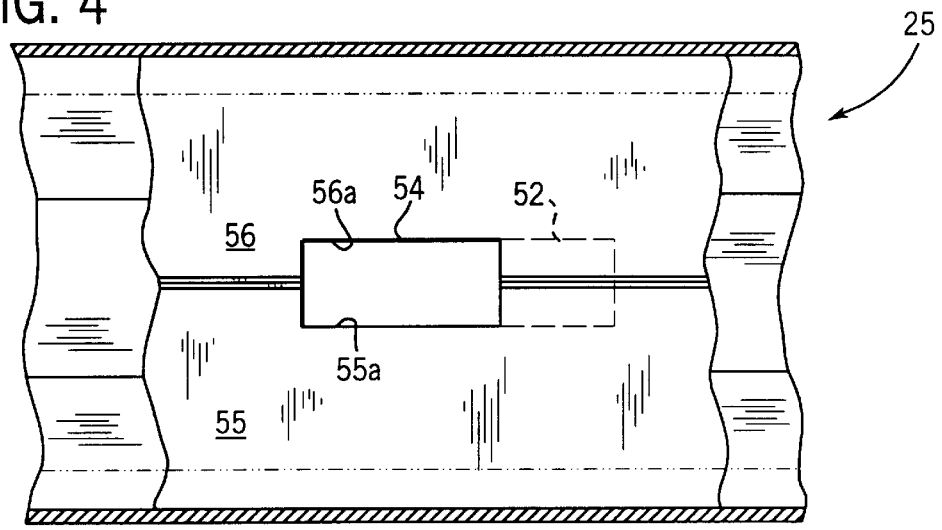
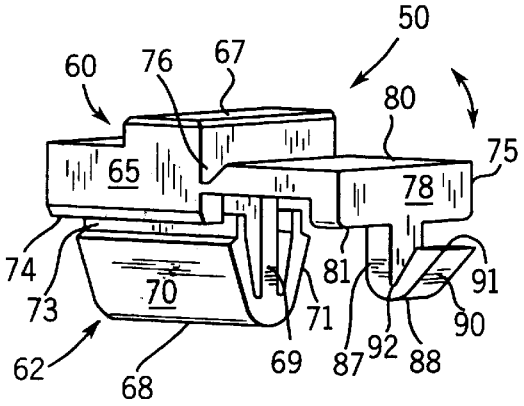
FIG. 5
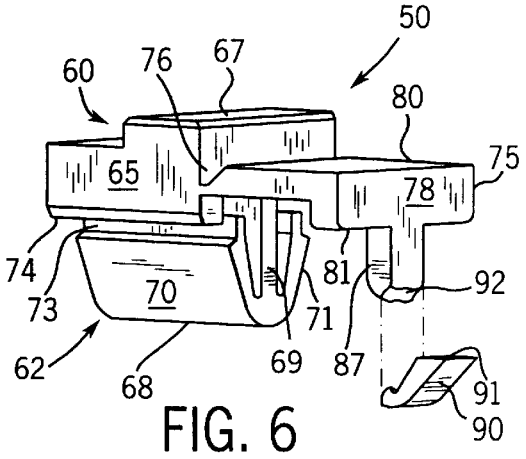
FIG. 6

RING LOCK FOR ALBUM OR BINDER

CROSS-REFERENCES TO RELATED APPLICATIONS

If Any: None

BACKGROUND OF THE INVENTION

1. Field of the Invention

The present invention relates generally to the art of ring binders, such as those used to hold paper, photo album pages and the like. More particularly, the invention relates to a locking system for holding the binder's rings closed when a lock is in a first position to prevent unintentional or improper opening. In a second lock position, the rings may be opened at will by the user. In a still more specific form, the invention features a security component which prevents movement of the lock between the first and second positions without the use of a tool. The security component prevents removal of pages or the addition of refill pages to the binder while it is in a store, but after its removal from the lock, the ring lock and ring opening functions of the lock may be selected easily and quickly without the use of a tool.

2. Description of the Prior Art

Ring binders of all sorts and sizes are well-known in the art and are used for school notebooks, holding photographs, presentation materials, etc. Typically, the ring binders include a plurality (two and three being the most common) of ring pairs, at least one of which has a generally C-shape. The ring pairs each have ends which can be opened or placed together. When opened, sheet material to be held in the binders can be placed over the rings. When closed the sheet material is held securely in the ring binder. If both of the ring pairs are C-shaped, a generally circular ring is formed.

A variety of ring mounting and opening systems are also well-known, most of which have applicability for use with the features of the present invention. The simplest includes a pair of elongate metal plates mounted behind a ring binder body, the non-contacting ends of the ring pairs passing through a front surface of the body and being joined to separate plates. The ring pairs are opened and closed by merely pulling apart the contacting ends of the ring pairs. Most of such systems "snap" into the fully opened or fully closed positions, due to the manner in which the plates are mounted to the back of the body.

Other binder ring systems are also very common. One of these includes an unlocking tab, at either or both ends of the ring binder body, pressure on the rings on which causes the plates, and the attached ring pair elements to snap into their open positions. Different varieties of these devices can be closed, either by manual pressure or by lifting up on the aforementioned tabs. In many ring binders, only one of the ring elements is C-shaped, the other being straight with a bend at its outer end which contacts the other ring element.

Two types of problems are encountered with ring binders of the types just discussed. One is frequently noted during use of the binders or when the binder is accidently dropped or otherwise mishandled. In these cases, the rings pop open when they are not supposed to, and the contents inadvertently spill and become disorganized. This frustrating occurrence has happened to nearly everyone and can results in wasted time while the contents are reorganized and reinserted or, in more severe cases, the contents can become damaged.

A different type of problem is encountered by manufacturers and retailers of ring binder products. This problem occurs when a customer wrongfully opens the ring pairs to remove, add to or substitute sheet material for those which may have been supplied at the time the binder was placed on the shelf. As an example, photograph albums are typically sold with a predetermined number of album pages, each designed to support a plurality of photographs. The albums, however, are designed to hold many more pages, and the manufacturer makes, and the retailer sells "refill" sets. Unfortunately, it is quite common for a customer to open a new album, insert refill sheets and close the album, discarding the packaging of the refill sets. The customer then presents the enlarged album to the check-out person who scans the UPC code of the binder itself and does not notice the theft of the pages. Similar examples could be provided for other types of binders, where punched paper sets, index sets, colored dividers and the like, each made to be sold separately, are placed into the binder before the product is taken from the store.

The theft of refill sets and other similar "accessories" for ring binders costs manufacturers and retailers hundreds of thousands of dollars annually, and a solution to this problem which does not increase substantially the manufacturing cost of these products would represent a significant advance in this art.

One proposed solution to the last mentioned problem has previously been proposed by the assignee of the present invention, i.e. to place heat shrink sealing rings about the rings to prevent the opening of the rings at the store. The sealing rings are easily cut away, using scissors or a knife, after the product is taken home. While effective for the sole purpose for which they were designed, the sealing rings, once removed, do not prevent inadvertent or accidental opening of the rings.

FEATURES AND SUMMARY OF THE INVENTION

The present invention features a locking system for ring binders which, in a first mode, includes a component for preventing opening of the rings at the point of sale and which, in a second mode, allows the selective locking and unlocking of the ring pairs.

A further feature of the present invention is to provide a locking system for ring binders which includes a security component which can be removed only by the use of a tool.

A different feature of the present invention is to provide a locking system for ring binders in which the in-store security component is removable by the customer once the product is taken home.

Another feature of the present invention is to provide a locking system for ring binders in which a lock may be easily and quickly moved between a first position in which opening of the rings is permitted and a second position in which opening of the rings is prevented. This manipulation of the lock member is preferably accomplished without the use of any tools.

A still further feature of the present invention is to provide a locking system for ring binders which may be easily adapted to a variety of binder systems, including, but not limited to, those described above, i.e. any binder system where it is desirable in a first instance to prevent any opening and closing of the binder rings, and in a second instance to prevent or permit opening of the binder rings under controlled circumstances selected by the user or owner of the ring binder.

How these and other features of the invention are accomplished will be described in the following detailed description of a preferred embodiment thereof, taken in conjunction with the FIGURES. Generally, however, they are accomplished by providing a ring binder body, at least one and preferably two or more pairs of ring elements and elongate backing plates to which the ring elements are attached and which permit the rings to be snapped between open and closed positions. The binder of the preferred embodiment also includes a lock having at least two positions, a first one of which permits the opening of the ring elements and a second one of which prevents the opening of the ring elements. The preferred lock includes a ridge, which ridge is aligned with an opening formed in the elongate plates when the lock is in its first position, and which ridge is clear of the opening when the lock is in its second position. The preferred lock is a unitary, synthetic resin molding, slidable along a slot in the ring binder body. The lock further includes a security component maintaining the lock in its second position until the security component is released by a tool. Once the security component is released, and preferably removed by the binder purchaser, the lock can be easily and quickly moved between its first and second positions without using any tools. Other ways in which the features of the invention are accomplished will become apparent to those skilled in the art after they have read the following detailed description. Such other ways are deemed to fall within the scope of the present invention if they fall within the scope of the claims which follow.

DESCRIPTION OF THE DRAWINGS

In the following drawings, like reference numerals will be used to designate like components.

FIG. 3 is a sectional view taken along the line 3—3 of FIG. 2 and showing the binder body and the elongate plates;

FIG. 4 is a plan view taken from the rear and showing the plates opening in full line and the longer lock slot in phantom;

FIG. 5 is a perspective view of the lock with the security component;

FIG. 6 is a perspective view of the lock with the security component removed therefrom;

DETAILED DESCRIPTION OF THE PREFERRED EMBODIMENT

Before proceeding with the detailed description of the preferred embodiment of the invention, several general comments can be made about the applicability and the scope thereof.

First, the ring lock for albums and binders can be employed on many types of photo albums, school notebooks and other types of binders, and is not to be limited with regard to the size of the covers or the type of sheet material used therewith, nor to any particular number of ring element pairs, although three such pairs are shown in certain of the FIGURES.

Second, the materials of constructions are not critical. Steel is used in the preferred embodiment for the binder body, rings and plate components and a synthetic resin, such as nylon, is used for the lock. However, other metals, alloys and resins can be used. For example, the lock could be metal and be used with either metal or plastic body and plate components.

Third, the type of opening mechanism with which the ring lock of the present invention may be used can also vary and include the illustrated spring plate system, the tab system described above, or other ring opening and closing systems known to the art.

Fourth, the location of the lock along the binder body can vary. In the illustrations it is between two rings, but it could be located closer to either end or the middle without departing from the intended scope of the invention.

Fifth, the illustrated lock includes a security component which can be torn or cut away from the body of the lock along a line of weakness created during the lock molding process. Other techniques could be employed for removing the component, or for that matter, attaching the component to the lock in the first place. For example, the component could be a separate piece from the lock and the removable therefrom after it is released by the purchaser. One way of coupling the two pieces would be to use a pin on one and a hole or socket on the other, but different attachment systems, such as he use of fasteners, could be substituted. Furthermore, the invention is intended to cover structures in which the security component separates automatically from the balance of the lock during the release step, e.g. by designing the line of weakness to accomplish this mode of operation.

Sixth, text or symbols could be provided on the lock or the ring binder body to tell the user how the lock should be moved to place it in the aforementioned first and second positions. If text is used, it could be provided in any language, font style, size, color, etc.

Figure 1:
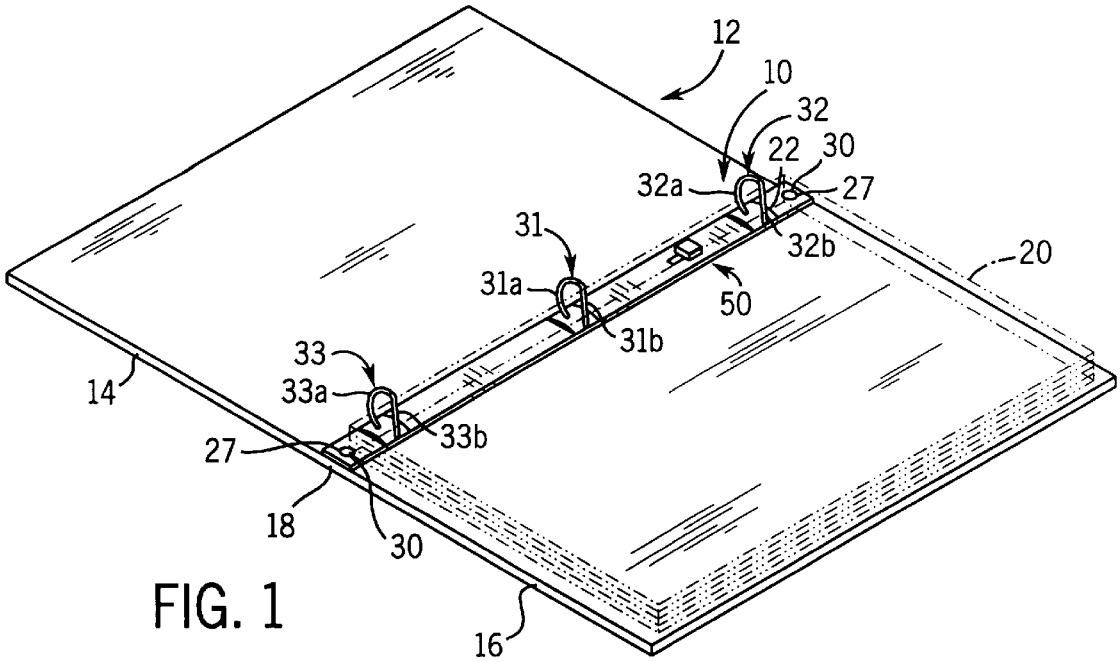
FIG. 1 is perspective view of a photo album according to the most preferred form of the present invention and showing the ring elements closed, photo album pages secured by the rings and the lock in its ready for sale position.

Proceeding now to the description of the FIGURES, FIG. 1 shows a perspective view of the ring lock system 10 for albums and binders. A photograph album 12 is used for illustrative purposes only and includes front cover 14, back cover 16, spline 18 and a plurality of pages 20. The pages 20 are each three-hole punched, with the holes being designated 22.

Ring lock system 10 includes further features which, in and of themselves are well-known. They include a ring binder body 25 (see FIGS. 1–4) which is elongate and generally rectangular in plan view. Binder body 25 includes a through opening 27 near each end and a fastener 30 passes through each of openings 27 to secure the binder body 25 to spline 18. Furthermore, the rings 31–33 are conventional and each include a pair of ring elemental designated "a" and "b" for each ring 31–33. For example, ring element 31*a* is generally "C" shaped and includes an upper end 31*d* and a lower end (not visible in FIGS. 1 or 2). Ring element 31*b*, on the other hand, is more "L" shaped and includes a right angle bend 31*e* at its top, terminating in an upper end 31*f* arranged to engage end 31*d* of ring element 31*a* when ring elements 31*a* and 31*b* are closed. Like ring element 31*a*, ring element 31*b* has a lower end not visible in FIGS. 1 or 2.

A pair of openings 40 are provided in binder body 25 for each of rings 31–33, allowing the lower ends of ring elements 31*a*, 31*b*, 32*a*, 32*b*, 33*a* and 33*c* to penetrate the upper surface 57 of ring binder body 25. These lower ends are each bent toward the longitudinal center line of body 25 and, as will be explained in greater detail hereafter, are attached to plates which reside within body 25 and above the exposed inner surface of spline 18.

FIG. 1 also shows the novel lock 50 used with system 10, and more details concerning lock 50 will be provided in following sections of the specification. Generally, however, for present purposes it should be understood that lock 50 is slidingly coupled to binder body 25 through a rectangular slot 52 best shown in FIG. 1.

Figure 2:
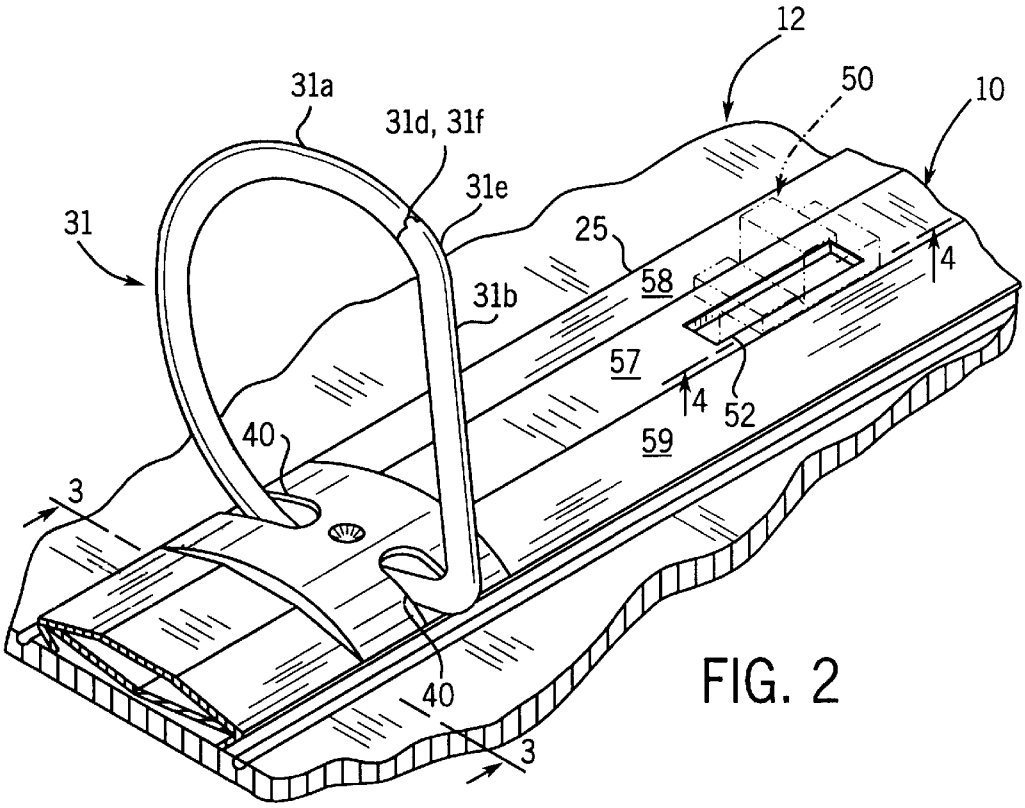
FIG. 2 is a perspective view of a portion of the ring binder shown in FIG. 1 and showing the lock slot.

FIG. 2 shows limited portions of some of the components of FIG. 1, with the covers 14 and 16, spline 18 and pages 20 totally or partially removed for ease of subsequent explanation. The slot 52 is clearly shown, and it is located approximately midway between rings 31 and 32 and along the longitudinal centerline of body 25. Shown best in FIG. 4 is a rectangular opening 54 located below slot 52, the opening 54 having approximately the same width as slot 52. The ends of slot 52 and opening 54 which are closest to rings 32 are directly above one another. The other end of slot 52, however, which is closer to ring 31, extends for a greater distance than that of opening 54. In other words, slot 52 is longer than opening 54.

FIG. 3, a cross-section through ring binder body 25, shows further known features of typical snap type ring binders, i.e. a pair of elongate plates 55–56. The cross-sectional shape of body 25 is also clear from this FIGURE. It includes the upper surface 57, a pair of downwardly sloping side portions 58–59 extending on either side of upper surface 57 and a pair of lower sections 60–61 inwardly bent from the outer side edges of portions 58–59. The plates are held within body 25 by the inwardly bent portions, as well as by a series plate tabs which are conventional and do not, in and of themselves, for part of the invention.

FIG. 3 also shows the welds 62 which join the lower ends of the ring components 31*a* and 31*d*, 32*a* and 32*d*, and 33*a* and 33*d* to plates 55–56. This construction is known and further details of it need not be supplied here as the body and plate construction does not, in and of itself, form part of the present invention. It should be understood, however, that the construction permits the upper ends "d" and "f" of the ring elements to be displaced relative to one another, during which movement the adjoining inner edges of plates 55 and 56 will snap into the phantom line position shown in FIG. 3.

FIG. 4 does, however, show how plates 55 and 56 are modified to accommodate the improvements brought about by the present invention. More specifically, the rectangular shape of opening 54 is created by a pair of cut away portions 55*a* and 56*a* in adjacent edges of the plates 55 and 56. In this FIGURE, the longer slot 52 in the upper surface 57 of body 55 is also apparent and is illustrated by a phantom line.

To begin the discussion of the construction of lock 50 it should be understood that lock 50 includes an upper portion which extends above the upper surface 57 of body 25 and a lower portion which extends within the cavity formed by body 25 and plates 55 and 56. It can also be mentioned briefly here that this inner portion includes a ridge which is substantially the same shape as opening 54 and that when the ridge is positioned directly over or aligned with the opening 54, the plates 55 and 56 can snap to their phantom line position as shown in FIG. 3. On the other hand, movement of the ridge away or clear of the opening 54 prevents normal movement of plates 55 and 56.

Lock 50 is shown in detailed perspective in FIG. 5. The upper portion just described is referenced generally as 60, while the lower portion is shown as 62. As illustrated, lock 50 is a unitary molding, prepared from a synthetic resin such as nylon or high density polyethylene.

Lock 50 includes four major components, a main body, a tab, an insert and a security component. The first is a main body portion 65 which has an upper, generally planar or stepped top 67. Top 67 is the part of lock 50 touched by a purchaser to move lock 50 between its two primary positions. This will usually be done by placing a thumb or finger on top 67 and sliding lock 50 in the appropriate direction. The illustrated lock includes a single step, adding additional non-slip characteristics.

The main body portion also includes a depending ridge 68, which is generally U-shaped in transverse cross-section. Ridge 68 is supported from the main body portion 65 by a single longitudinal web 69, and the ridge 68 includes a pair of side walls 70 and 71. This construction allows a flexing action of the side walls 70 and 71 permitting insertion of the lock 50 into slot 52 by pressing it into place. A relieved area 73 between the top of the sides 70 and 71 and the bottom 74 of main body portion 65 creates a groove which captures the longitudinal edges of the slot 52 and allows sliding movement of the main body portion 65 and the ridge 68. This is clearly illustrated in FIGS. 7–10 which shown various positions of lock 50 with respect to other components of the ring binder lock system 10.

The second major component of the lock 50 is a tab 75. It is coupled to main body portion 65 along a living hinge 76 which is relatively thin, thereby allowing the forward end of tab 75 to be raised and lowered (see FIG. 8). Tab 75 also includes a planar top 80 having a width greater than that of slot 52, thus allowing the tab to be raised from a position in which its bottom surface 81 contacts upper surface 57 of the binder body 25 to an elevated position where the bottom 81 forms an acute angle with upper surface 57.

Depending from the front 78 of tab 75 and extending downwardly therefrom is the third primary lock component, i.e. the insert 87. Insert 87 has a width just slightly less than the width of slot 52, permitting the insertion of insert 87 into the interior cavity of binder body 25 by putting slight downward pressure on the top 80 of tab 75. Insert 87 has a slightly curved bottom 88. The distance between the insert 87 and the remote end of ridge 68 is just slightly less than the length of slot 52, thus preventing movement of the lock 50 when the insert 87 is within cavity of binder body 25.

Now that the first three portions of lock 50 have been described, partial operation thereof can now be explained. With lock 50 inserted in slot 52 so that the relieved area 73 slides therein, the lock 50 is located in its first position when it is at the position shown in FIG. 7. The ridge 68 is located within the cavity formed by body 25 and plates 55 and 56 and is not located in alignment with the opening 54. The insert 87 is in its depressed position thereby permitting movement of tab 75 about the hinge 76 described above. In this position the rings 31–33 cannot be opened because ridge 68 will prevent movement of plates 55 and 56 to the position shown in phantom lines in FIG. 3.

Figure 7:
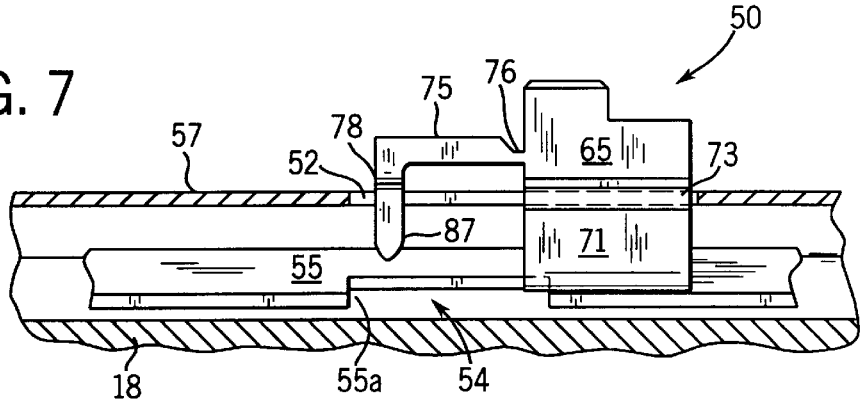
FIG. 7 is a side sectional view showing the lock in its first position and the lock ridge preventing ring element opening, the security component being removed from the lock.
Figure 8:
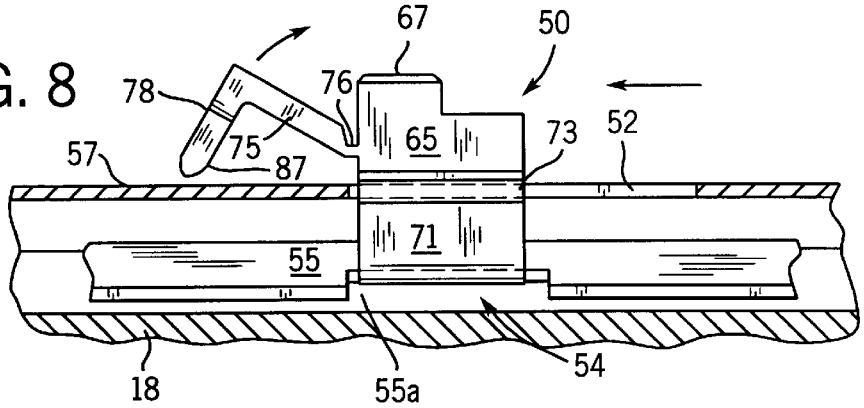
FIG. 8 is a side sectional view showing the lock in its second position and the lock ridge aligned with the plate opening to permit ring element opening, the security component being removed from the lock.

To permit ring opening, tab 75 is raised and lock 50 is moved to the position shown in FIG. 8, wherein the ridge 68 is located directly above opening 54. Alignment is insured if the slot length is selected so that the movement of the lock is to its opposite end from that shown in FIG. 7, and such movement is accomplished by the user placing a finger on the top 67 of the main body portion 65 and sliding the lock 50 in the desired direction. The relieved area 73 and the side walls of slot 52 determine the amount of force required for movement, since a friction fit exists between the components. They should be sized such that the lock will remain in the selected position, no matter what the orientation of the album 12, so that inadvertent movement of lock 50 does not occur, but the force required to move lock 50 should not be so great as to present difficulty to the user, even a person with limited manual dexterity.

Figure 9:
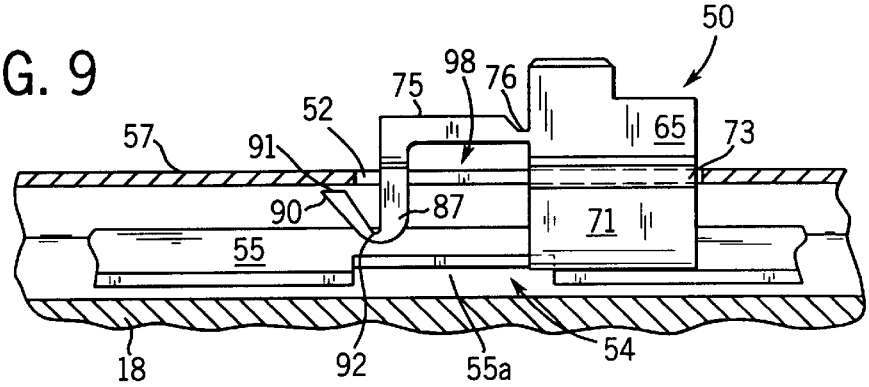
FIG. 9 is a side sectional view showing the lock, with security component attached, in the ready for sale position.
Figure 10:
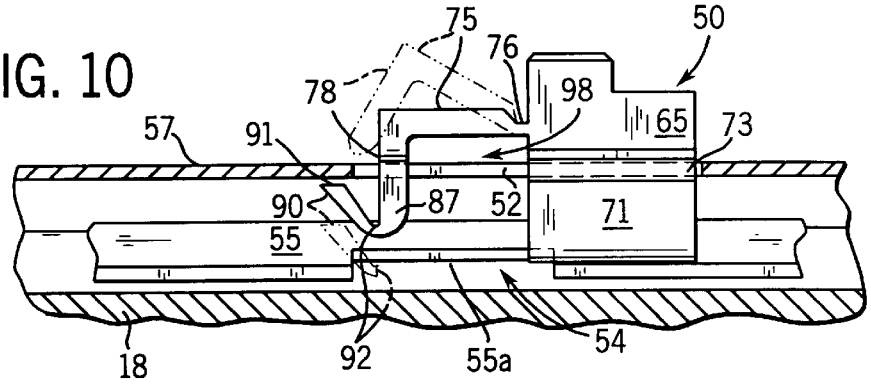
FIG. 10 is a side sectional view showing the lock with the security component attached but ready for removal by the purchaser.

The final feature of lock 50 is a security component 90 attached to bottom 88 of insert 87 (see FIG. 6) in such a manner that a hook is formed, the tip 91 of which fits beneath the upper surface 57 of body 25. Insert 87 and security component 90 are arranged so that movement of the lock 50 between the positions shown in FIGS. 7 and 8 is not possible unless security component 90 is forced out of the cavity using a special tool such as a screw driver or knife. Security component 90 is preferably joined to the bottom of insert 87 along a line of weakness 92 so that security component will bend downwardly or preferably break off when tab 75 is first forced open as described above. If it does not self-detach it can easily be cut off by the binder purchaser after the first elevation of tab 75. The security position of lock 50 is illustrated in FIG. 9, while FIG. 10 shows the tab 75 raised and the security component lift within the binder body cavity. Tool insertion, such as for a screw driver is at the location designated 98 in FIGS. 9 and 10.

The security component 90 can be embodied in a number of other ways, as long as its objective is satisfied, i.e. to prevent the easy elevation of tab 75 and the consequent unrestrained movement of lock 50. Another example of a construction of the security component would be to have a thin, rod like projection extend from the tip 91 thereof into a small hole in the upper surface 57 of binder body 25. This security component would be released in this further illustrative example by pushing downwardly on the rod using the sharp point of a pin, pencil or the like, to allow the security component to be forced upwardly by raising tab 75 using a tool.

While the present invention has been described and illustrated using a single preferred embodiment and references to certain modifications, the invention is not to be limited thereby but is to be limited solely by the scope of the claims which follow.

What is claimed is:

1. A lock system for a ring binder comprising:

an elongate ring binder body having a front surface and a cavity;

at least one ring, each ring including a pair of ring elements, each of the ring elements including a first end extending through the binder body and into the cavity and a second end, the ring elements being arranged to move between a first closed position wherein the second ends are adjacent one another and a second open position in which the second ends are spaced apart from one another;

a pair of elongate plates extending along the binder body, the second ends of each pair of ring elements being coupled to different ones of the plates, the plates being arranged to resist movement of the ring elements between their first and their second positions; and a lock moveable between a locked position and an unlocked position, wherein the ring elements are allowed to move back and forth between their open and closed positions when the lock is in its unlocked position and the ring elements are prevented from being moved to their open position when the lock is in its locked position, and wherein the plates have adjoining edges and an opening is provided in at least one of the adjoining edges, the lock including a ridge aligned with the opening when the lock is in its unlocked position.

2. The lock system of claim 1 wherein the plates are spring plates arranged to snap the ring elements into their open and closed positions and resist movement of the ring elements from either their open or closed positions unless a force is applied to the ring elements.

3. The lock system of claim 1 wherein the lock prevents movement of the plates relative to each other when the lock is in its locked position.

4. The lock system of claim 1 wherein the body includes a slot and the lock slides within the slot between its unlocked and its locked positions.

5. The lock system of claim 4 wherein the plates are spring plates arranged to snap the ring elements into their open and closed positions and resist movement of the ring elements from either their open or closed positions unless a force is applied to the ring elements.

6. The lock system of claim 4 wherein the lock prevents movement of the plates relative to each other when the lock is in its locked position.

7. The lock system of claim 4 wherein the plates have adjoining edges and an opening is provided in at least one of the adjoining edges, the lock including a ridge aligned with the opening when the lock is in its unlocked position.

8. The lock system of claim 1 wherein the lock includes an insert in the cavity for insuring that the lock remains in its locked position, the insert being selectively removable from the cavity to permit lock movement.

9. The lock system of claim 8 wherein the lock is easily and quickly moved by the user of the lock system by applying a sliding force thereto when the insert is removed from the cavity.

10. The lock system of claim 9 wherein the insert releasably secures the lock to the binder body.

11. The lock system of claim 8 wherein the lock further includes a security component coupled to the insert for maintaining the lock in its locked position unless released by the user.

12. The lock system of claim 11 wherein the security component is only releasable by the user with a tool.

13. The lock system of claim 12 wherein the security component is easily separated from the insert once it has been released by a user.

14. The lock system of claim 13 wherein the security component is joined to the insert along a line of weakness.

15. The lock system of claim 14 wherein the lock, insert and security component are formed as a unitary molding of a synthetic resin, the line of weakness being a thin resin joint between the insert and the security component.

16. A lock system for ring binders of the type which include a plurality of rings which snap between open and closed positions, the improvement comprising a lock moveable between first and second positions, the lock preventing opening of the rings when in the first position and permitting opening and closing of the rings when in the second position, the lock further including a security component to prevent movement of the lock from the first to the second position without the use of a tool.

17. The lock system of claim 16 wherein the ring binder includes a binder body and elongate plates which together define a cavity, the plates moving into the cavity when the rings are opened, the lock including a lower portion located within the cavity and which prevents ring opening when the lock is in its first position.

18. The lock system of claim 17 wherein an opening is provided in the plates and the lower portion of the locked aligned with the opening when the lock is in its second position, whereby to permit opening of the rings.

19. The lock system of claim 17 wherein the binder body includes an elongate slot and the lock slides between the ends of the slot to move between its first and second positions.

20. The lock system of claim 17 wherein the security component must be released to allow the lock to move between its first and second positions.

21. The lock system of claim 20 wherein the security component is separable from the lock after being released.

22. The lock system of claim 21 wherein the lock and security component are an integral plastic molding and a line of weakness exists between the security component and the lock to facilitate separation thereof.

23. The lock system of claim 21 wherein the lock comprises a main body portion, a flexible tab, an insert and a security component, and wherein the security component is coupled to the insert.

24. The lock system of claim 23 wherein the flexible tab is coupled to the main body portion by a living hinge the security component is coupled to the insert, whereby the insert maintains the lock in its first position after separation of the security component therefrom until the user applies a lifting force to the tab to remove the insert from the cavity.

25. The lock system of claim 24 wherein the main body portion, tab, insert and security component are an integral plastic molding.

* * * * *